US006329976B1

(12) United States Patent
Johnson et al.

(10) Patent No.: US 6,329,976 B1
(45) Date of Patent: Dec. 11, 2001

(54) ELECTRO-OPTICAL DISPLAY DEVICE WITH TEMPERATURE-DEPENDENT DRIVE MEANS

(75) Inventors: Mark T. Johnson; Adrianus A. Van Der Put, both of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/137,281

(22) Filed: Aug. 20, 1998

(30) Foreign Application Priority Data

Aug. 26, 1997 (EP) ..... 97202611

(51) Int. Cl.[7] ..... G09G 3/36
(52) U.S. Cl. ..... 345/101
(58) Field of Search ..... 345/101, 94, 95, 345/103, 96, 87, 90, 92; 349/72, 158

(56) References Cited

U.S. PATENT DOCUMENTS 4,319,237 3/1982 Matsuo et al. ..... 340/713
4,679,043 * 7/1987 Marokawa ..... 345/103
4,761,058 8/1988 Okubo et al. ..... 350/331 T
5,510,807 * 4/1996 Lee et al. ..... 345/103
5,774,100 * 6/1998 Aoki et al. ..... 345/87
5,903,251 * 5/1999 Mori et al. ..... 345/101
5,926,162 * 7/1999 Wood et al. ..... 345/101
5,929,833 * 7/1999 Koshobu et al. ..... 345/101
5,936,603 * 8/1999 Lippmann et al. ..... 345/101
6,069,600 * 5/2000 Saishu et al. ..... 345/87

FOREIGN PATENT DOCUMENTS 0373565 6/1990 (EP) ..... G09G/3/36
0657864A1 1/1995 (EP) ..... G09G/3/36

* cited by examiner

*Primary Examiner*—Regina Liang
*Assistant Examiner*—Ronald Laneau

(57) ABSTRACT

Display device with a TFT matrix and auxiliary capacitors, in which a gate-bias voltage is adapted upon a change of temperature so as to give a video response which is as uniform as possible for the full temperature range.

20 Claims, 3 Drawing Sheets

ELECTRO-OPTICAL DISPLAY DEVICE WITH TEMPERATURE-DEPENDENT DRIVE MEANS

BACKGROUND OF THE INVENTION

The invention relates to a display device comprising an electro-optical material between two substrates of which at least one substrate is transparent, and a first substrate is provided with picture electrodes, in which each picture electrode is coupled via a switching element to a row electrode and a column electrode, and in which the picture electrode is capacitively coupled to a further electrode. The device further comprises drive means for providing the row electrodes with a selection signal and the row electrodes or the further electrode with a bias signal.

In this application, the term "capacitively coupled" is understood to mean that there is a coupling via an (auxiliary) capacitance, for example, by (partial) overlap of a picture electrode associated with a row and a part of the row electrode associated with a subsequent (or previous) row.

The second substrate may be provided with electrodes too (counter electrodes) defining at overlapping areas (a matrix of) picture elements. Picture elements may also be defined by picture electrodes in the same substrate (in plain switching).

Such display devices are used in, for example television and monitor applications.

A display device of the type mentioned in the opening paragraph is described in EP-A-0 657 864. This document describes how a DC component across the liquid crystal material is prevented in a liquid crystal display device by adaptation of a selection signal. To this end, the selection signal consisting of a gate pulse is extended with so-called gate-bias voltages applied during a gate-bias period. Where the selection signal is referred to in this application, the signal is understood which causes the switching element to conduct (generally the actual gate pulse of a TFT transistor). Where a bias signal or voltage, "(gate)-bias signal" or "(gate)-bias voltage" are mentioned, a bias signal or bias voltage as described in EP-A-0 657 864 is referred to, and therefore not the voltage across a row electrode during non-selection although when the gate-bias signal is presented to a selection electrode, although during a gate-bias period such a gate-bias signal may temporarily have a level which is equal to that of a non-selection signal. Instead of being presented to a row electrode, the bias signal may also be presented, for example, to a common connection for a number of capacitances within one row.

Due to the capacitive coupling between a picture electrode with an adjacent row electrode, it is true that the speed of the display device is considerably increased, but at this speed (and hence the transmission to be reached within one field period) flicker and artefacts (in moving images) still appear to occur frequently.

OBJECTS AND SUMMARY OF THE INVENTION

It is an object of the invention to provide a display device of the type described above in which the above-mentioned drawbacks are at least partly obviated.

To this end, a display device according to the invention is characterized in that the drive means comprise means for adapting the voltage level of the bias signal in dependence upon the temperature.

It has surprisingly been found that the level of the gate-bias signal has a considerable influence on the switching rate of the display elements, while the voltages to be used can be very well realized with ICs.

The capacitive division between an auxiliary capacitance and the capacitance of the pixel leads to a voltage across the pixel after the actual selection during switch-off of the gate-bias voltage. The switching rate of the pixel is also determined by this voltage. It appears that, dependent on the temperature, the pixel has a strongly varying dynamic behavior which gives rise to flicker and artefacts. By changing the gate-bias voltage also with the temperature, this change of dynamic behavior is substantially completely compensated.

The temperature measurement can be performed in different manners, for example, with one or more separate sensors or with a sensor integrated in the drive circuit.

These and other aspects of the invention are apparent from and will be elucidated with reference to the embodiments described hereinafter.

BRIEF DESCRIPTION OF THE DRAWINGS

In the drawings:

FIG. 2 shows a pulse pattern of a display device according to the invention, while

The Figures are diagrammatic and not to scale; corresponding elements are generally denoted by the same reference numerals.

DESCRIPTION OF THE PREFERRED EMBODIMENTS

Figure 1:
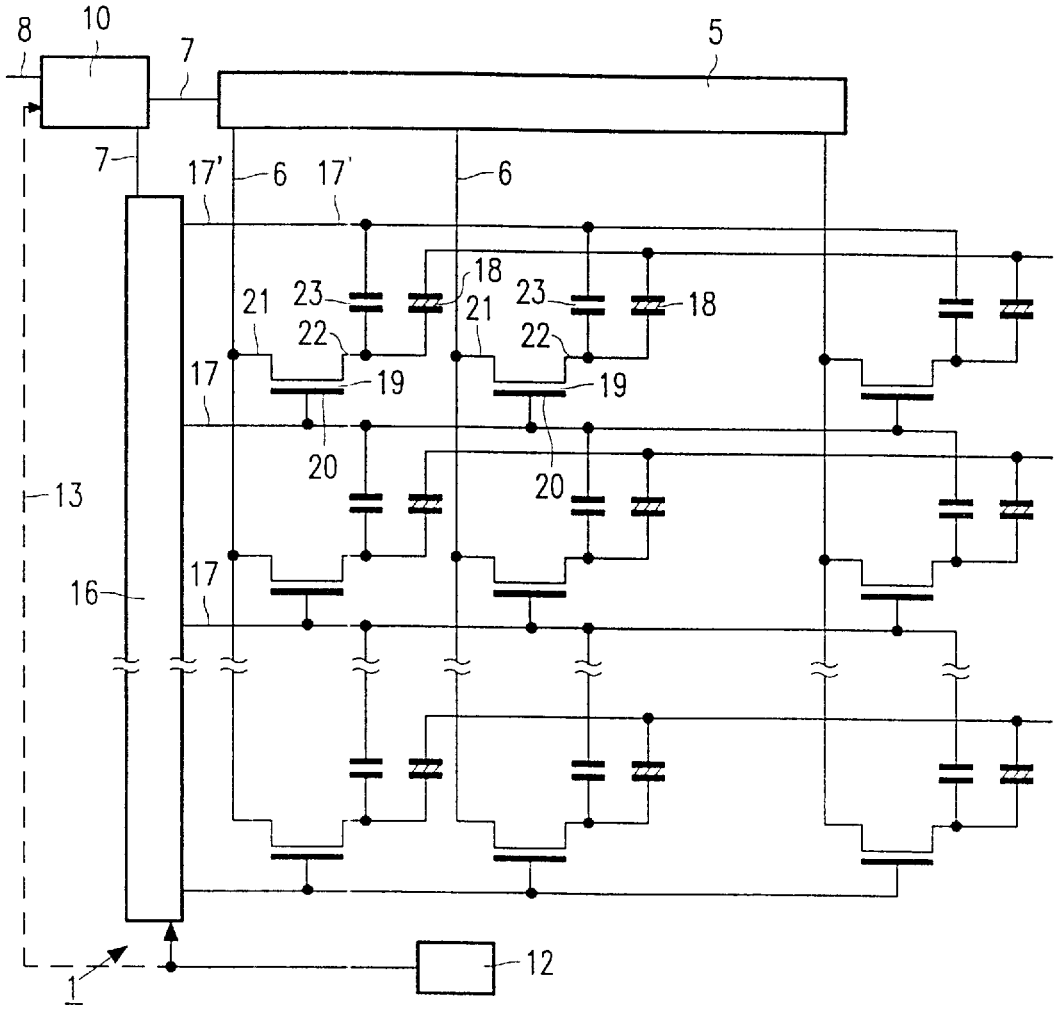
FIG. 1 is an electric circuit diagram of the display device.

FIG. 1 is an electric equivalent circuit diagram of a part of a display device 1 to which the invention is applicable. It comprises a matrix of pixels 18 at the location of crossings of row or selection electrodes 17 and column or data electrodes 6. The row electrodes are consecutively selected by means of a row driver 16, while the column electrodes are provided with data via a data register 5. To this end, incoming data 8 are first processed, if necessary, in a processor 10. Mutual synchronization between the row driver 16 and the data register 5 takes place via drive lines 7.

Drive signals from the row driver 16 select the picture electrodes via thin-film transistors (TFTs) 19 whose gate electrodes 20 are electrically connected to the row electrodes 17, and the source electrodes 21 are electrically connected to the column electrodes. The signal present at the column electrode 6 is applied via the TFT to a picture electrode of a pixel 18 coupled to the drain electrode 22. The other picture electrodes are connected to, for example one (or more) common counter electrode(s).

The display device of FIG. 1 also comprises an auxiliary capacitor 23 at the location of each pixel. In this example, the auxiliary capacitor is connected between the common point of the drain electrode 22 and the display element in a given row of pixels, on the one hand, and the row electrode of the previous row of pixels, on the other hand; other configurations are alternatively possible, for example, between said common point and the next row of pixels, or between this point and an electrode for a fixed voltage.

To prevent picture deviations, the display device comprises an extra row electrode 17'.

Figure 2:
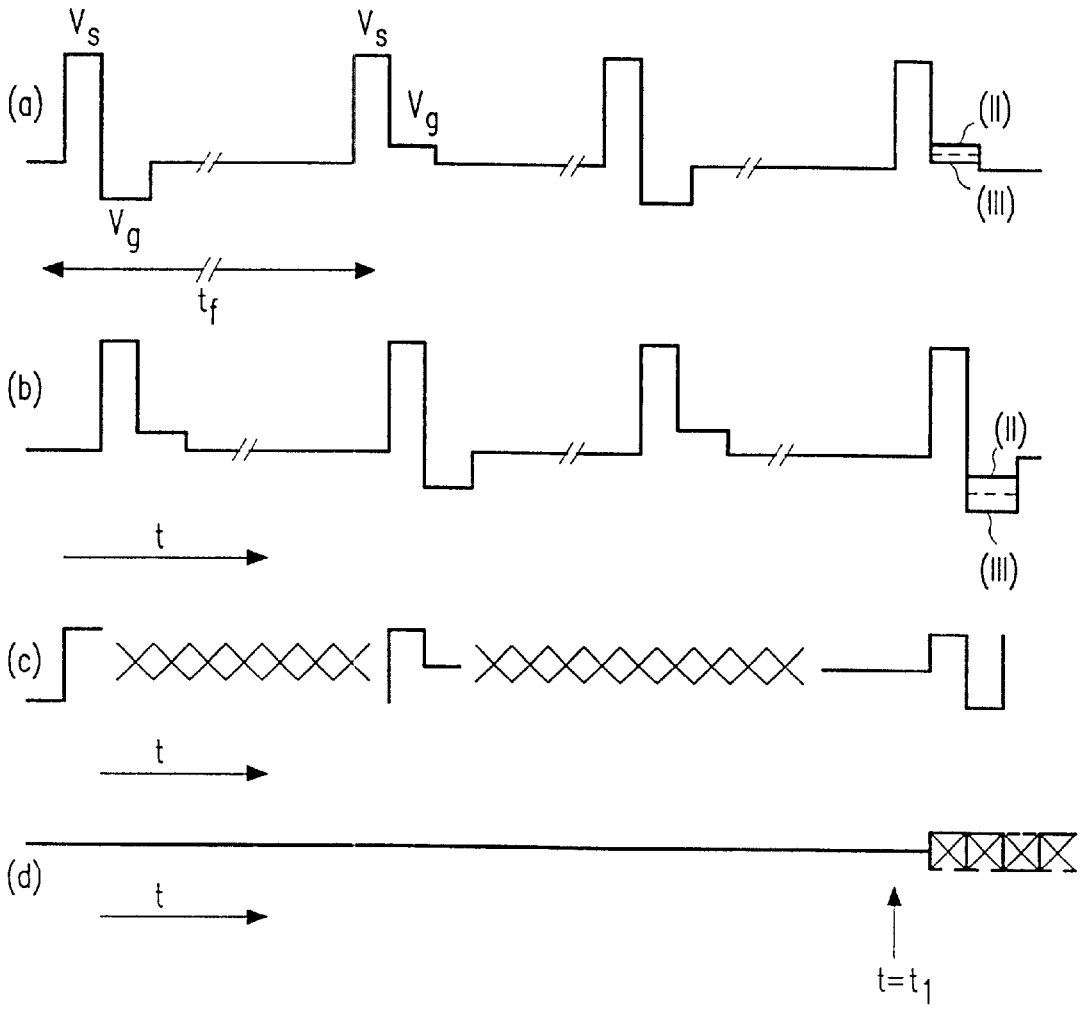

FIG. 2 shows some drive signals for the device of FIG. 1. During a field period $t_f$, which is of the order of 20 msec (50 Hz applications), the n rows are consecutively selected by means of a selection signal $V_S$ during a row selection period $t_{row}$ (FIGS. 2*a*, 2*b*), while data voltages are presented to the column electrodes (FIG. 2*c*). As mentioned hereinbefore, a gate-bias signal $V_g$ is also presented during a bias period (in this example after selection). During the balance of a field period, a non-selection voltage is provided.

In this example, this gate-bias voltage immediately follows the selection voltage and remains present until after selection of the next row. However, such gate-bias signals may have different shapes and may be shifted in time, or they may be presented prior to the selection signal (if the auxiliary capacitors are coupled to the next row).

To illustrate the invention, it is assumed that the temperature changes at the instant $t=t_1$; in the present example, the temperature decreases. Without further measures, the response of the pixels would change considerably, as will be explained hereinafter.

Figure 3A:
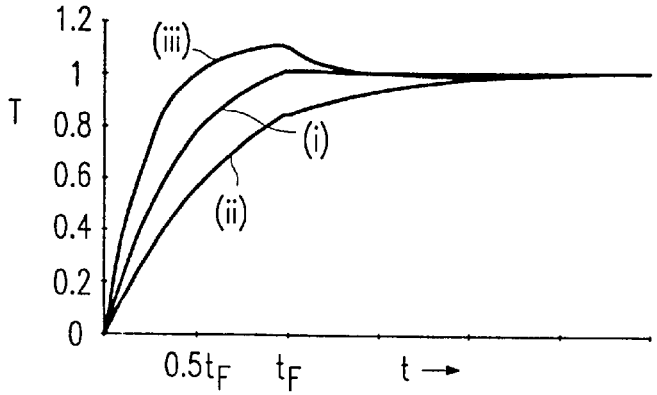
FIG. 3 shows the effect of changing temperatures on the response of a display device without the inventive step and a display device in which the inventive step is used.

FIG. 3*a* shows the change of transmission as a function of time, when a pixel switches between two grey levels for different values of the temperature of the liquid crystal material, if the gate-bias voltage is not changed (denoted by the broken lines in FIGS. 2*a*, 2*b*). Curve (i) applies to a temperature of approximately 25° C. of the liquid crystal material or its ambience. Curves (ii) and (iii) show such a variation at approximately 15° C. and approximately 40° C., respectively. It is apparent therefrom that the desired transmission value is not reached at a too low temperature, which gives rise to flicker, whereas at too high temperatures the transmission becomes temporarily too high, which also gives rise to flicker. In the case of moving images, artefacts (smear, flicker) occur along the periphery of moving elements.

Figure 3B:
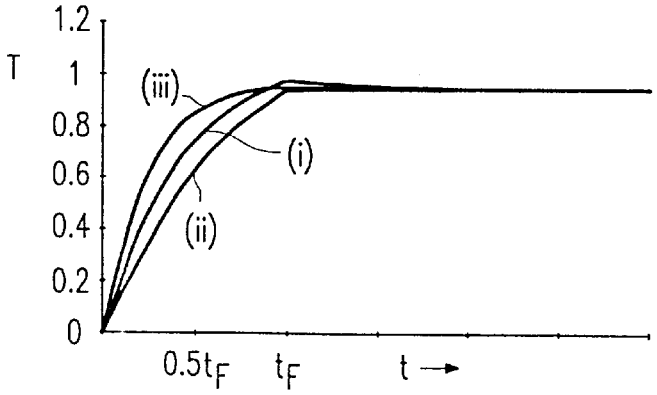

In the device according to the invention, the temperature change at instant $t_1$ is followed by a correction of the voltage level of the gate-bias signal; in the relevant example (decrease of the temperature) the voltage level is increased. FIG. 3*b* shows the associated change of transmission as a function of time when a pixel switches between different grey levels for different values of the temperature of the liquid crystal material. Curve (i) applies again to a temperature of approximately 25° C. of the liquid crystal material or its ambience, while the voltage level of the gate-bias signal is the same as in the situation of FIG. 3*a*. Curves (ii) and (iii) show a similar variation at approximately 15° C. and approximately 40° C., respectively. In curve (ii), the voltage level of the gate-bias signal is increased after $t=t_1$ (which is denoted by solid line curves in FIGS. 2*a*, 2*b*). In curve (iii), the voltage level of the gate-bias signal is decreased after $t=t_1$. It is apparent from the Figure that the response for the difference temperatures does not give rise or hardly gives rise to flicker or artefacts.

The changed voltage level of the gate-bias signal may give rise to a DC component across the liquid crystal material or to variations of brightness. To prevent this, an auxiliary signal of the desired polarity can be presented to the counter electrode (FIG. 2*d*) when the gate-bias signal changes. The auxiliary signal is preferably adjustable, dependent on the temperature. If necessary, the data signal can also be adapted.

To register the temperature change, the display device comprises a temperature sensor 12 (FIG. 1). More sensors are preferably used for a large surface area of the display device.

The signal supplied by the temperature sensor is applied (either or not in a digital form) via signal lines 13 to the row driver 16 or (as denoted by a broken line) to the processor 10, or to an external processor.

Figure 4:
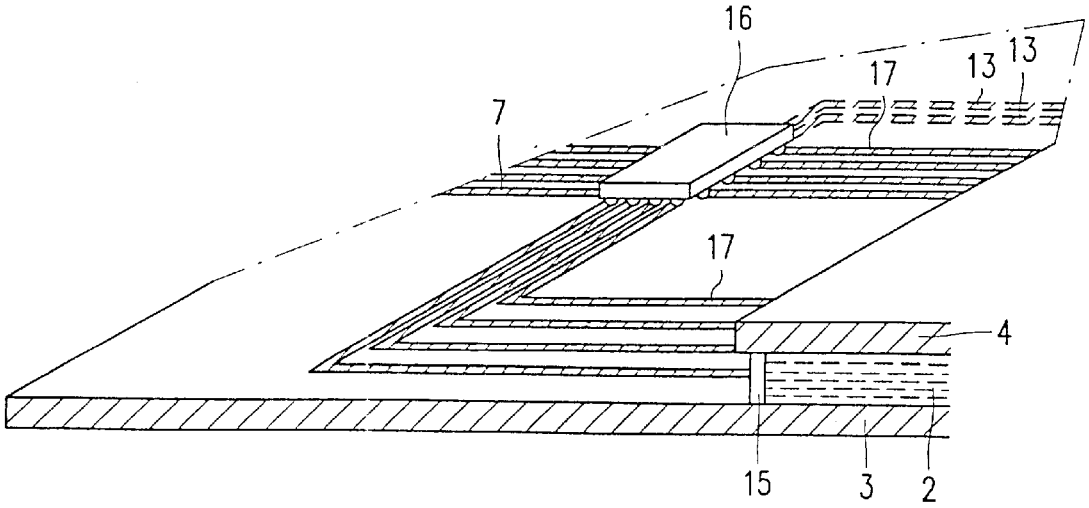
FIG. 4 is an elevational view of a part of the display device.

FIG. 4 shows a part of the display device 1 with substrates 3, 4 which enclose an electro-optical medium 2, in this case a liquid crystal, within a sealing edge 15. FIG. 4 further shows a row driver 16 providing row electrodes 17 with the correct selection voltages. In this example, the temperature sensor 12 is integrated in the row driver 11 which is preferably realized as a face-down bonded chip so that it can register temperature changes (in this case of the substrate 3) as correctly as possible. The row driver is driven via connections 7 by means of a processor (not shown). The temperature sensor may also be localized in the liquid crystal, the information being presented either to the row driver (via signal lines 13 shown by way of broken lines) or to a processor. This processor may be alternatively an external drive unit.

In summary, the invention relates to a display device with a TFT matrix and auxiliary capacitors, in which the drive voltages, notably the gate-bias voltage, are adapted upon a change of temperature so as to give a video response which is as uniform as possible for the full temperature range.

What is claimed is:

1. A display device comprising an electro-optical material between two substrates, at least one of said substrates being transparent, a plurality of picture electrodes provided on a first of said substrates, each picture electrode being coupled through a respective switching element to a row electrode and a column electrode, and each picture electrode being capacitively coupled to a further electrode, and drive means for providing the row electrodes with respective selection signals for respective row selection periods of time during a field period, for providing the respective row electrodes or the further electrode with respective bias signals for respective bias periods of time during said field period, a respective row selection period and respective bias period together being less than one field period, and for providing the respective row electrodes or the further electrode with respective non-selection signals for the respective balances of said field period, characterized in that each respective bias period has a duration greater than the respective row selection period of time, and the drive means comprises means, responsive to the device temperature, for changing the voltage level of the respective bias signals.

2. A display device as claimed in claim 1, characterized in that the respective bias signal is provided immediately following the respective selection signal.

3. A display device as claimed in claim 2, characterized in that the respective bias signal is provided immediately following the respective selection signal and remains present until after the end of the respective selection signal of the next row.

4. A display device as claimed in claim 1, characterized in that the device further comprises at least one counter electrode, and the drive means comprises means for providing the counter electrode with an auxiliary signal.

5. A display device as claimed in claim 4, characterized in that the auxiliary signal is adjustable, dependent on the temperature, to prevent changes in the bias signal giving rise to a DC component across the electro-optical material.

6. A display device as claimed in claim 4, characterized in that the auxiliary signal is adjustable, dependent on the temperature, to prevent changes in the bias signal causing variations in display brightness.

7. A display device as claimed in claim 1, characterized in that the picture electrode is capacitively coupled to an adjacent row electrode.

8. A display device as claimed in claim 7, further comprising a respective auxiliary capacitor coupled between each respective picture electrode and the preceding row electrode.

9. A display device as claimed in claim 8, characterized in that the respective auxiliary capacitor provides the respective bias signal immediately following the respective selection signal.

10. A display device as claimed in claim 1, characterized in that the device is provided with at least one temperature sensor on one of the two substrates.

11. A display device as claimed in claim 10, characterized in that the temperature sensor is provided in a face-down bonded chip.

12. A display device as claimed in claim 10, characterized in that drive means and a temperature sensor are realized in one semiconductor body.

13. A display device as claimed in claim 1, characterized in that the second substrate is provided with at least one counter electrode.

14. A display device comprising an electro-optical material between two substrates, at least one of said substrates being transparent, a plurality of picture electrodes provided on a first of said substrates, each picture electrode being coupled through a respective switching element to a row electrode and a column electrode, and each picture electrode being capacitively coupled to a further electrode, and drive means for providing the row electrodes with respective selection signals for respective row selection periods of time during a field period, for providing the respective further electrode with respective bias signals for respective bias periods of time during said field period, a respective row selection period and respective bias period together being less than one field period, and for providing the respective row electrodes or the further electrode with respective non-selection signals for the respective balances of said field period, characterized in that the drive means comprises means, responsive to the device temperature, for changing the voltage level of the respective bias signals.

15. A display device as claimed in claim 14, characterized in that the respective bias signal is provided immediately following the respective selection signal and remains present until after selection of the next row.

16. A display device as claimed in claim 14, characterized in that the device further comprises at least one counter electrode, and the drive means comprises means for providing the counter electrode with an auxiliary signal.

17. A display device as claimed in claim 16, characterized in that the auxiliary signal is adjustable, dependent on the temperature, to prevent changes in the bias signal giving rise to a DC component across the electro-optical material.

18. A display device as claimed in claim 16, characterized in that the auxiliary signal is adjustable, dependent on the temperature, to prevent changes in the bias signal causing variations in display brightness.

19. A display device as claimed in claim 14, characterized in that the picture electrode is capacitively coupled to an adjacent row electrode, and the device further comprises a respective auxiliary capacitor coupled between each respective picture electrode and the preceding row electrode.

20. A display device as claimed in claim 19, characterized in that the respective auxiliary capacitor provides the respective bias signal immediately following the respective selection signal.

* * * * *